US007493064B2

(12) United States Patent
Narita et al.

(10) Patent No.: US 7,493,064 B2
(45) Date of Patent: Feb. 17, 2009

(54) ELECTRIC CONDUCTIVE MEMBER, PROCESS CARTRIDGE AND IMAGE FORMING APPARATUS

(75) Inventors: Yutaka Narita, Sagamihara (JP); Makoto Nakamura, Ebina (JP); Toshio Kojima, Isehara (JP); Tadaaki Hattori, Hadano (JP); Taisuke Tokuwaki, Sagamihara (JP); Tadayuki Oshima, Atsugi (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 111 days.

(21) Appl. No.: 11/602,971

(22) Filed: Nov. 22, 2006

(65) Prior Publication Data

US 2007/0212110 A1 Sep. 13, 2007

(30) Foreign Application Priority Data

Nov. 24, 2005 (JP) ..... 2005-339309

(51) Int. Cl.
*G03G 15/02* (2006.01)

(52) U.S. Cl. ..... 399/176; 361/221; 399/168; 492/39

(58) Field of Classification Search ..... 399/176, 399/174, 168, 159, 286, 279, 303, 313; 361/221; 492/18, 39, 47

See application file for complete search history.

(56) References Cited

U.S. PATENT DOCUMENTS

| | | | | |
|---|---|---|---|---|
| 6,587,656 | B2 * | 7/2003 | Lee et al. | 399/303 X |
| 7,113,727 | B2 * | 9/2006 | Kosuge et al. | 399/176 |
| 7,151,904 | B2 * | 12/2006 | Narita et al. | 399/159 |
| 2003/0175046 | A1 * | 9/2003 | Namiki et al. | 399/176 |
| 2006/0188293 | A1 * | 8/2006 | Narita et al. | 399/176 |
| 2007/0065178 | A1 * | 3/2007 | Shimojo et al. | 399/168 |

FOREIGN PATENT DOCUMENTS

| | | | |
|---|---|---|---|
| JP | 2004-309762 A | * | 11/2004 |
| JP | 2004-354477 | | 12/2004 |
| JP | 2005-266774 | | 9/2005 |
| JP | 2006-251031 | | 9/2006 |
| JP | 2006-284824 | | 10/2006 |

OTHER PUBLICATIONS

Machine translation of JP 2004-309762 A dated May 8, 2008.*
Extended European Search Report dated Apr. 16, 2007 for corresponding European Application No. 06024351.5.

* cited by examiner

*Primary Examiner*—Sophia S Chen
(74) *Attorney, Agent, or Firm*—Harness, Dickey & Pierce, P.L.C.

(57) ABSTRACT

An electrical conductive member is configured to prevent a shape distortion in gap retaining members caused by that the gap retaining members are fitted to an end surface of an electric resistance adjusting layer, and to be able to maintain a gap between the electric residence adjusting layer and an image carrier for a long-term in a constant state with a high accuracy.

13 Claims, 4 Drawing Sheets

RELATED ART

ELECTRIC CONDUCTIVE MEMBER, PROCESS CARTRIDGE AND IMAGE FORMING APPARATUS

CROSS-REFERENCE TO RELATED APPLICATIONS

The present application claims the priority benefit of Japanese Patent Application No. 2005-339309, filed on Nov. 24, 2005. The content of the above-identified application is incorporated herein by reference.

BACKGROUND OF THE INVENTION

1. Field of the Invention

Example embodiments relate to an electrical conductive member (a charging member, a developer earner, a transfer member, or the like) which is provided adjacent to an image carrier, such as a photoconductive drum, a process cartridge including the electrical conductive member and the image carrier formed as at least one unit, and an image forming apparatus such as a copying machine, a printer, a facsimile or the like, which is provided with the electrical conductive member.

2. Description of Related Art

For recent years, in an image forming apparatus of an electrophotographic system such as a copying machine, a printer and a facsimile or the like, a so-called contact-type charging device, which makes a charge roller to contact onto a surface of a photoconductive drum, is commonly used as a charging device which charges equally the surface of the photoconductive drum (the image carrier), instead of a charging apparatus of a corona discharge system.

The contact-type charging device produces smaller amount of ozone and can be charged with a lower voltage in contrast to the charging device of the corona discharge system. However, there have been problems, one is that substance composing a charge roller exudes and adheres onto the surface of a photoconductive drum which abuts with the charge roller, so that the fact of so-called "traces of charge roller" occurs, and other one is that a charge roller abutting with the photoconductive drum vibrates by an application of an alternating voltage, and the fact of so-called "charging noise" is easy to occur in a system of applying the alternating voltage to the charge roller superimposedly.

In addition, as for the contact-type charging device, there have been problems, for examples, one is that a charging ability declines due to residual toner remaining on a surface of a photoconductive drum if the residual toner is transferred to a side of a charge roller after transferring a toner image onto a sheet, and other one is that an abutting portion of a charge roller onto a photoconductive roller has been permanently distorted in a situation after a long-term rest of rotating of a photoconductive drum.

Therefore, to solve the problem described above, a so-called a non-contact type charging device has been proposed, which makes a charge roller to close to a surface of the charge roller and to charge without any contact. (for reference, see JP A 2004-354477).

In a charge roller or a charging member as shown in FIG. 7 of JP A 2004-364477, a electrical resistance adjusting layer 22 is provided on a surface periphery of an electrical conductive supporter 21, which is an axial rod of the charge roller 20, and a set of ring-shaped gap retaining members abutting on both end sides of a photoconductive drum (not shown) are respectively provided on the both sides of the electrical resistance adjusting layer 22, so that a constant gap is retained between the charge roller (the electric resistance adjusting layer) and the photoconductive drum (not shown).

Meantime, as for the conventional charge roller (the charging member) shown in FIG. 7, the gap retaining members 23 are fitted into both end sides of the electrical conductive supporter 21 in such a way of making the ring-shaped gap retaining members 23 to abut with the both sides of the electrical resistance adjusting layer 22 provided on the surface periphery of the electrical conductive supporter.

Therefore, when the gap retaining members 23 are fitted to the both end sides of the electrical conductive supporter 21, if the gap retaining members 23 are in contact with end surfaces of the electrical resistance adjusting layer 22 as pressed thereon, the shapes of the gap retaining members 23 are distorted. Thus, a gap volume provided between the charge roller 20 (the electric resistance adjusting layer) and the photoconductive drum changes dramatically, so that there is a possibility of generating defective conductivity.

SUMMARY OF THE INVENTION

Therefore, example embodiments provide an electrical conductive member, a process cartridge and an image forming apparatus, which can prevent shape-distortions of gap retaining members, which is caused by pressing the gap retaining members onto end surfaces of an electric resistance adjusting layer, and can maintain the gap between the electric resistance adjusting layer and an image carrier for a long-term with a high accuracy. For instance, it is possible for the resistance of the electroconductive member to be adjusted by a thickness and/or a material of the electric resistance adjusting layer.

To attain the above-described object, the electrical conductive member according to example embodiments include a long electric conductive supporter, an electric resistance adjusting layer provided on a peripheral surface of the electric conductive supporter, and gap retaining members provided on both end sides of said electric resistance adjusting layer. An outer peripheral surface of each of the gap retaining members abuts with each of the both end sides of an image carrier provided adjacent to the electric resistance adjusting layer to form a predetermined gap between the electric resistance adjusting layer and the image carrier, and the electric resistance adjusting layer has at least one step provided in vicinity of each of the both ends in a longitudinal direction of the electric resistance adjusting layer, and an inner peripheral surface of each of the gap retaining members is fixed by abutting with at least two surfaces forming each of the steps of the electric resistance adjusting layer, and an inner end surface of each of the gap retaining members is out of contact with the most inner end surface forming each of the steps of the electric resistance adjusting layer.

According to the above-mentioned structure, since the inner end surfaces of the gap retaining members are prevented from being pressed onto the most inner end surface of the electric resistance adjusting layer, so that no distortion of the gap retaining members occurs, and the gap between the electric resistance adjusting layer and the image carrier is maintained in a constant state with a high accuracy for a long time. With the gap retaining members being fixed on the steps of the electric resistance adjusting layer, even if the thickness of the gap retaining members alter due to an environmental variation, it is possible for the gap change to be prevented by following the thickness change of the electric resistance adjusting layer.

BRIEF DESCRIPTION OF THE DRAWINGS

Example embodiments will become more apparent by describing, in detail, example embodiments thereof with reference to the attached drawings, wherein like features are represented by like reference numerals, which are given by way of illustration only and thus do not limit the present invention.

DESCRIPTION OF EXAMPLE EMBODIMENTS

Figure 1:
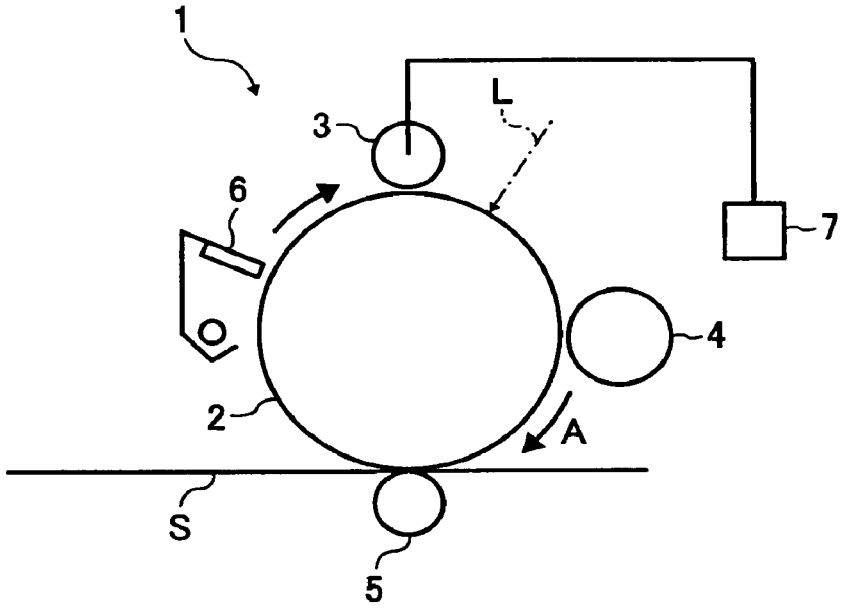
FIG. 1 illustrates a schematic view of a substantial part of an image forming apparatus having a charge roller (electrical conductive member) according to an example embodiment.

Example embodiments will be described in accordance with embodiments shown in the accompanying drawings. FIG. 1 is a schematic structural view showing a main part of an image forming apparatus according to an example embodiment. FIG. 1 is also one example in which the electrical conductive member according to example embodiments are applied to as a charge roller as an electrical charge member of the image forming apparatus.

As shown in FIG. 1, the image forming apparatus 1 (e.g. a copying machine, a printer, a facsimile etc.) of an electro photographic system includes the next followings as main component members: a photoconductive drum 2 as an image carrier which is rotatably supported; a charge roller (an electrical charge member) 3 which is arranged about the photoconductive drum 2 and charges the photoconductive drum 2; a development roller 4 of a development apparatus which transfers toner to an electrostatic latent image formed on a surface of the photoconductive drum 2 by an exposure of a laser beam L from an exposure equipment (not shown); a transfer roller 5 to transfer a toner image onto a recording sheet S and the toner image is formed on the photoconductive drum 2; a cleaning device 6 which cleans the surface of the photoconductive drum 2 after the transferring. In addition, in the image forming apparatus 1, the charge roller 3 is provided in a vicinity of the photoconductive drum 2 without any contact to the photoconductive drum 2. The detailed description on the charge roller 3, which is the features of the present invention, will be described hereinafter.

When the image forming apparatus 1 first forms an image, the surface of the photoconductive drum 2 rotating in the direction of an arrow A is charged equally to be high potential in minus polarity by the charge roller 3 applied with a predetermined voltage from a power source 7. By the exposure of the laser beam L from the exposure equipment (not shown), the electrostatic latent image is formed corresponding to image information inputted on the surface of the photoconductive drum 2. Then, after the image is developed (visualized) as a toner image by adhering the toner to the electrostatic latent image by the development roller 4, and then the toner image is transferred onto a recording sheet S which is transported between the photoconductive drum 2 and the transfer roller 5 in a predetermined timing by the transfer roller 5 applied with a transferring bias.

The recording sheet S on which the transferred toner image is transported to a fixing device (not shown) and is ejected out after the fixing process. At the same time, after the transferring of the toner image, residual transferring toner or the like which remain on the surface of the photoconductive drum 2 are removed and cleaned by the cleaning device 6.

Figure 2:
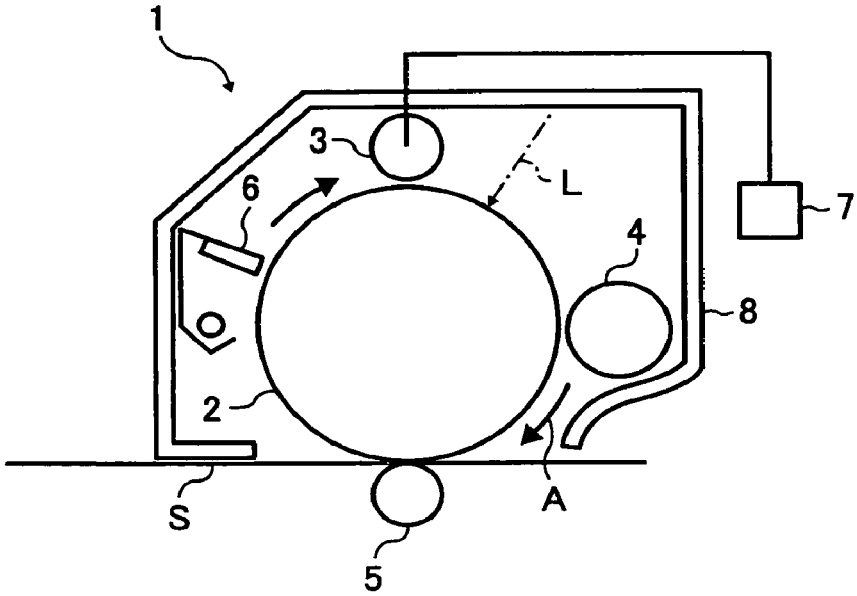
FIG. 2 illustrates a schematic view of a substantial part of the image forming apparatus having an image forming part as a process cartridge, that contains the charge roller (electrical conductive member) according to an example embodiment.

In addition, as shown in FIG. 2, it is possible that the photoconductive drum 2, the charge roller 3, the development roller 4 and the cleaning device 6 are provided within a process cartridge 8 to form a unit as a structure in which the process cartridge 8 is attached to the image forming apparatus 1 with attached and removed at will.

Figure 3:
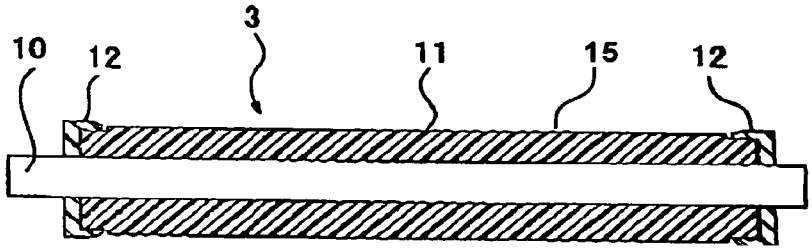
FIG. 3 illustrates a longitudinal sectional view of the charge roller (electrical conductive member) according to an example embodiment.
Figure 4:
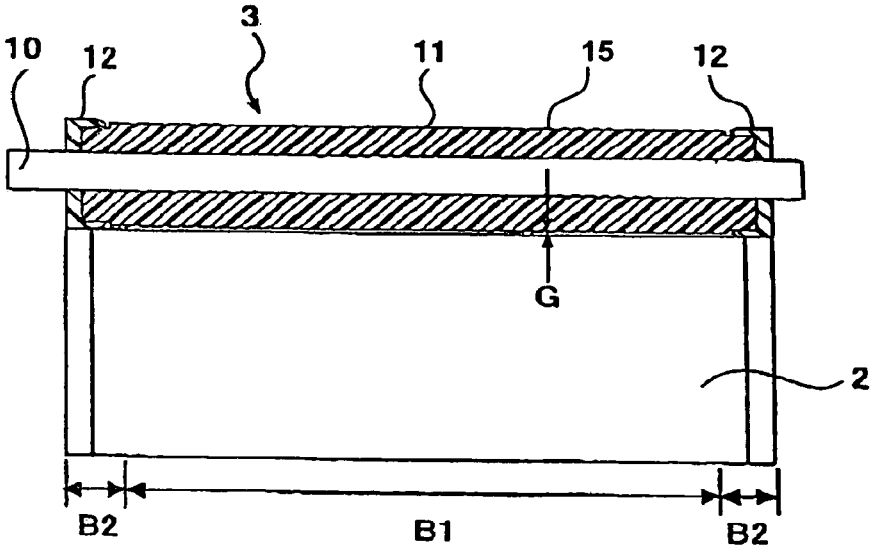
FIG. 4 illustrates a view of a positional relationship between the charge roller (electrical conductive member) and a photoconductive drum.
Figure 5:
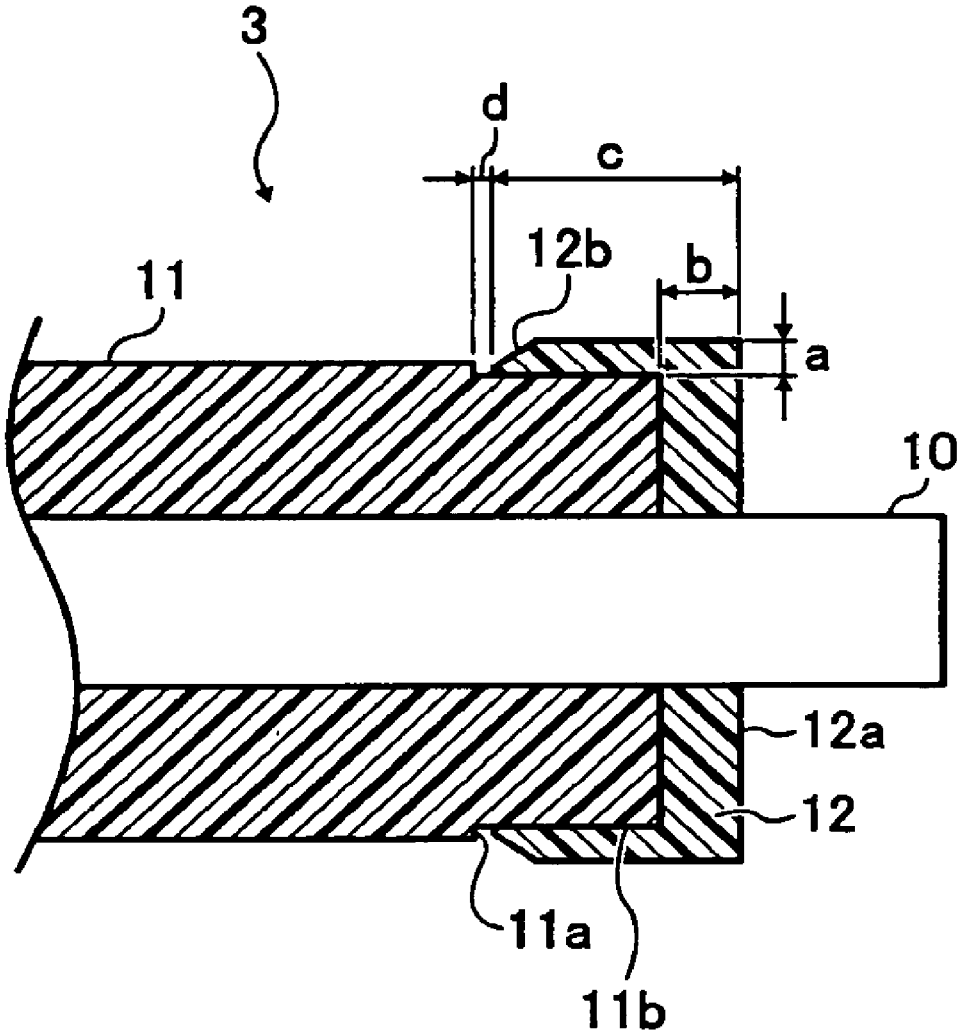
FIG. 5 illustrates an enlarged sectional view of a vicinity of one end portion in the charge roller (electrical conductive member) according to an example embodiment.

Next, a structure of the charge roller (the electrical conductive member) 3 will be explained. FIG. 3 is a schematic view of a longitudinal section which shows the charge roller according to the present embodiment. FIG. 4 is a view of a positional relationship between the charge roller and the photoconductive drum. FIG. 5 is an enlarged sectional view showing a vicinity of one end part of the charge roller.

As shown in FIG. 3, the charge roller 3 of a proximity charging system includes an electrical conductive supporter 10 in a shape of cylinder, which is made of a SUM-Ni coat or the like in a long and cylindrical shape, to which the voltage from the power source 7 is applied (see FIG. 1), an electric resistance adjusting layer 11, which is provided on a peripheral surface of the electrical conductive supporter 10, and a set of gap retaining members 12 for forming a gap between the electric resistance adjusting layer 11 of the charge roller 3 and the photoconductive drum 2 (see FIG. 4). A rotary drive system (not shown) is connected to the charge roller 3, and is configured to rotate in a reverse direction against the rotating direction of the photoconductive drum 2 that is rotating by a driving of a motor (not shown). In addition, a surface layer 15, which is for reducing an adhesion of extraneous matters such as the toner or the like, is provided on a surface of the electric resistance adjusting layer 11.

As shown in FIG. 4, the electric resistance adjusting layer 11 of the charge roller 3 is positioned on to a slightly outer side of an image forming region B1 of the photoconductive drum 2, outer peripheral surfaces of each of the gap retaining members provided on uneven parts of both end sides of the electric resistance adjusting layer 11 are abutting on a non-image forming regions B2 formed on both end sides of the photoconductive drum 2. An external diameter of the electric resistance adjusting layer 11 is formed slightly smaller than those of the gap retaining members in the both side portions of the electric resistance adjusting layer 11. Herewith, a predetermined gap G is formed between the electric resistance adjusting layer 11 of the charge roller 3 and the photoconductive drum 2.

As just described, the predetermined gap G is formed between the electric resistance adjusting layer 11 of the charge roller 3 and the photoconductive drum 2 by the gap retaining members 12, so that if a voltage is applied to the charge roller 3, a discharge between the electric resistance adjusting layer 11 of the charge roller 3 and the photoconductive drum 2 occurs and thereby, the surface of the photoconductive drum 2 is charged. In the present embodiment, a thickness of the electric resistance adjusting layer 11 and those of the gap retaining members 12 are adjusted to ensure the gap less than 100 micrometers. If the gap G is more than 100 micrometers, it is necessary to apply a high voltage to the charge roller 3, and an electrical degradation of the photoconductive drum 2 or an anomalous discharge is easy to occur.

The electric resistance adjusting layer 11 is formed of a thermoplastic resin composition on which high-molecular-form ionic conductive material is dispersed. The thermoplastic resin composition includes, for example, commodity resins such as polyethylene (PE), polypropylene (PP), polymethylmethacrylate (PMMA), polystyrene (PS) and the copolymers (AS, ABS) or the like. As the high-molecular form ionic conductive material is preferably a polymer compound containing polyetheresteramide constituent. Polyetheresteramide is ionic conductive polymer material, and is dispersed homogeneously on the molecular level in matrix polymer and fixed in. Herewith, a resistance value variation is not caused together with such disperse troubles as seen in a composition on which an electron conductive agent such as metal oxide, carbon black or the like is dispersed. As is the polymer material, a bleeding out is not easy to occur.

The thickness of the electric resistance adjusting layer 11 is formed within 100 to 500 micrometers according to the present embodiment. The reason is that, if a thickness of the electric resistance adjusting layer 11 is more than 500 micrometers, a thickness variation of the electric resistance adjusting layer 11 increases by swelling caused by an absorption of moisture of the electric resistance adjusting layer 11 under high temperature and high humidity circumstances and that if the thickness of the electric resistance adjusting layer 11 is less than about 100 micrometers, a dielectric breakdown may occur on the electric resistance adjusting layer 11 at the time that the photoconductive drum 2 is charged by applying voltage to the charge roller 3.

A volume resistivity value of the electric resistance adjusting layer 11 is preferably within $10^6$ to $10^9$ Ω·cm. That is to say, if the volume resistivity value of the electric resistance adjusting layer 11 is more than $10^9$ Ω·cm, a charging ability is insufficient, and if the volume resistivity value of the electric resistance adjusting layer 11 less than $10^6$ Ω·cm, an anomalous discharge (a leak) occurs against the photoconductive drum 2 by a voltage concentrating.

As materials for forming the surface layer 15, fluorine resin, silicon resin, polyamide resin, polyester resin or the like are excellent at nonadhesive, and are preferable in terms of preventing the adhesion of the toner. In addition, since the resin material is electrically insulation, a resistance of the surface layer 15 is adjusted by dispersing various conductive materials on resin. The surface layer 15 is formed in such a way that the resistance value thereof is larger than that of the electric resistance adjusting layer 11, whereby it is possible to avoid the voltage concentrating on a defective portion of the surface and to avoid the anomalous discharge (leak). But if the resistance value is too high, the charge ability is inadequate, so that a difference of the resistance value between the surface layer 15 and the electric resistance adjusting layer 11 is preferably less than 10.sup.3.OMEGA.cm.

Forming the surface layer 15 onto the electric resistance adjusting layer 11 can be effected by dissolving the materials (fluorine resin, silicon resin, polyamide resin, polyester resin or the like) in an organic solution to prepare coating compositions and with wet-type coating method such as spray coating, dipping, roll coating or the like. As for a film thickness of the surface layer 15 is preferably about 5 to 30 micrometers.

In addition, in the charge roller 3, since the electrical property is important, it is necessary that the surface layer 15 is electrical conductive. It is possible for the surface layer 15 to be electrical conductive by dispersing electrical conductive material into the resin material. The electrical conductive material is not limited particularly, and includes (electrical conductive carbons such as Ketjen Black EC, Acethylene Black or the like), and (carbons for rubbers such as SAF, ISAF, HAF, FEF, GPF, SRF, FT, MT or the like), (carbon for color which is treated with oxidization or the like), pyrolysis carbon, (metals and metal oxides such as indium doped tin oxide (ITO), tin oxide, titanium oxide, zinc oxide, copper, silver, germanium or the like), and (electrical conductive polymers such as polyaniline, polypyrrole, polyacetylene or the like).

There is also ionic conductive material as material for providing an electrical conductivity, which includes inorganic ionic conductive materials such as sodium perchlorate, lithium perchlorate, calcium perchlorate, lithium chloride or the like and additionally, organic ionic conductive materials such as denaturalized aliphatic acid dimethyl amminium ethosulphate, ammonium stearate acetate, lauryl ammonium acetate or the like.

As shown in FIG. 5, each of the both end portions of the electric resistance adjusting layer 11 has two surfaces respectively of an uneven end surface 11*a* and an uneven outer peripheral surface 11*b* to form a step respectively. An inner peripheral surface of a cylinder side of the gap retaining member 12 with adhesion bond coated is fitted to the uneven outer peripheral surfaces 11*b* of the electric resistance adjusting layer 11. An inner side of an outer end surface 12*a* of the gap retaining member 12 is abutting with an end surface of the electric resistance adjusting layer 11.

An apical end portion (the uneven end surface 11*a* side of the electric resistance adjusting layer 11) of the outer peripheral surface of the gap retaining member 12 is formed on inclined surface 12*b*. A pore for the electrical conductive supporter 10 to penetrate therethrough is formed on a middle portion of the outer end surfaces 12*a* of the gap retaining member 12. A predetermined gap d is provided between the uneven end surface 11*a* of the electric resistance adjusting layer 11 and the apical end of the inclined surface 12*b* of the gap retaining member 12, so as to keep the gap retaining member 12 away from being contact with the uneven end surface 11*a* of the electric resistance adjusting layer 11.

Next, a forming method of the charge roller 3 (the electrical conductive member) according to the present embodiment will be explained by referring to FIGS. 6A and 6B.

Figure 6A:
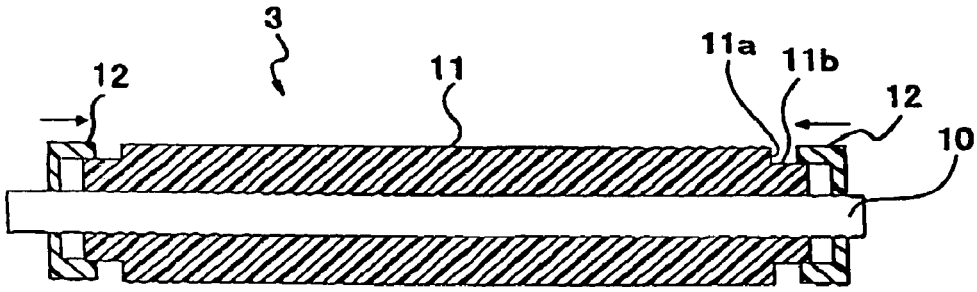
FIGS. 6A and 6B illustrate views of a method of forming charge roller (electrical conductive member) according to an example embodiment.

First, as shown in FIG. 6A, the electric resistance adjusting layer 11 in the shape of cylinder, which has the step (11*a*, 11*b*) formed on the each end side, is provided on the electrical conductive supporter 10 in the shape of cylinder. The gap retaining members 12 before inclined surfaces forming process on the inner apical end portion are fitted with adhesion bond coated to the respective step (the uneven end surface 11*a* and the uneven outer peripheral surface 11*b*) of the electric resistance adjusting layer 11. At this time, as described above, the gap is provided to prevent the uneven end surfaces 11*a* of the electric resistance adjusting layer 11 from being contact with the apical end sides of the outer peripheral surfaces of the gap retaining members 12.

Figure 6B:
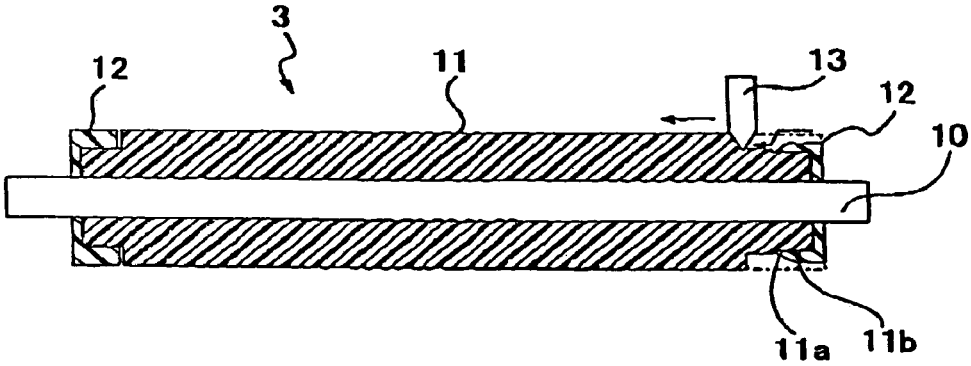
Figure 7:
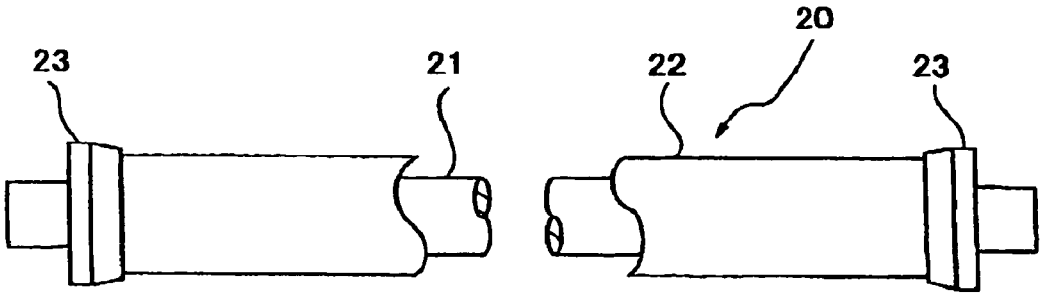
FIG. 7 illustrates a longitudinal sectional view of a charge roller (electrical conductive member) in a related art.

As shown in FIG. 6B, the inclined surface 12*b* is formed on the apical end sides of the outer peripheral surface of the gap retaining member 12 by a cutting work with a cutting tool 13 and the electric resistance adjusting layer 11 and the gap retaining member 12 are adjusted to a predetermined thickness to form the external diameter of the electric resistance adjusting layer 11 slightly smaller than an external diameter of the gap retaining members in the both end sides of the electric resistance adjusting layer 11. A left side of the electric resistance adjusting layer 11 and left one of the gap retaining members 12 as shown in FIG. 6B are in a state before the cutting work.

As described, it is possible for a variation of a difference of elevation between the electric resistance adjusting layer 11 and the gap retaining member 12 to be within ±10 micrometers with high accuracy by processing the electric resistance adjusting layer 11 and the gap retaining members 12 together by the cutting work with the cutting tool 13.

It is possible to prevent that the end portions of the tap retaining members 12 are peeled or plucked and so on, while the cutting work with the cutting tool 13, by pressing and fixing the gap retaining members 12, with an adhesive, onto each of steps (the uneven end surface 11*a* and the uneven outer peripheral surface 11*b*) of the electric resistance adjusting layer 11.

As a necessary property for the gap retaining members 12 are to keep the gap G (see FIG. 4) stable with high accuracy against an environmental variation and a long-term use, the gap G is formed between the charge roller 3 of the electric resistance adjusting layer 11 and the photoconductive drum 2. For the property, material with lowly hygroscopic and good abrasion resistance is preferable. It is also important that toner and toner additive are not adhesive and the photoconductive drum 2 is not abraded while its abutting and sliding on the photoconductive drum 2. Materials are selected to meet with those conditions.

As for materials in detail, which include for example resins such as polyethylene resin (PE), polypropylene (PP), polymethylmethacrylate (PMMA), polystyrene (PS) and the copolymer (AS, ABS) or the like and polycarbonate (PC), urethane, fluorine contained resin or the like. The gap retaining members 12 have preferably insulation properties of being more than $10^{13}$ Ω·cm in a volume resistivity valise. The reason that the gap retaining members 12 require the insulation properties is to prevent a leakage-current to occur between the gap retaining members and the photoconductive drum 2.

Before the gap retaining member 12 is fitted to each step (the uneven end surface 11*a* and the uneven outer peripheral surface 11*b*) of the electric resistance adjusting layer 11, the inner peripheral surfaces of the gap retaining members 12 is treated with a priming process, whereby effective primer components having polar and non-polar portions can be infiltrated into the gap retaining members 12 and oriented so that the surface modification in a bonding plane is occurred and the adhesion properties are increased dramatically.

As described, according to the charge roller 3 (the electrical conductive member), the image forming apparatus 1 including this charge roller (the electrical conductive member) 3 and the process cartridge 8, the gap is provided for keeping the uneven end surfaces 11*a* of the electric resistance adjusting layer 11 away from the apical end portions of the outer peripheral surfaces of the gap retaining members 12 (the apical portion of the inclined surface 12*b*), so that the gap retaining members 12 are prevented to fitted to the uneven end surfaces 11*a* of the electric resistance adjusting layer 11 and therefore it is possible to keep the gap G, between the electric resistance adjusting layer 11) and the photoconductive drum 2, stable with high accuracy for a long time.

Even if the gap retaining members 12 are fitted to and attached into the uneven outer peripheral surfaces 11*b* of the electric-resistance adjusting layer 11 and then a thickness of the electric resistance adjusting layer 11 (the surface-layer) changes due to the environmental variation, it is possible to prevent the gap G change between the electric resistance adjusting layer 11 (the surface layer) and the photoconductive drum 2 by following the changing of thickness in the electric resistance adjusting layer 11.

In the embodiment described above, it is an embodiment that the electrical conductive member according to the present invention is applied to the charge roller charging the photoconductive drum, and it is also possible for the electrical conductive member to be applied to the development roller and the transfer roller or the like provided on the image forming apparatus as well.

EMBODIMENTS

Next, to evaluate the electrical conductive member (the charge roller) in the structure as described above, some electrical conductive members in embodiments 1-4 and comparative examples 1-3 shown hereinafter were produced.

First Embodiment

An electrical conductive supporter (a core shaft) made of stainless with an external diameter of 8 mm was coated by an injection molding with a resin composition (the volume resistivity value: $2\times10^{6}$ Ω·cm) including ABS resin (Denka ABS GR-0500 manufactured by DENKI KAGAKU KOGYO) in 50% by weight and poly ether ester amide (IRGASTAT P18 manufactured by CHIBA SPECIALTY CHEMICALS) in 50% by weight, to form an electrical-resistance adjusting layer (an electric resistance adjusting layer) wherein an external diameter is 14 mm and external diameters of steps in both end sides are 11.3 mm.

Ring-shaped gap retaining members including high-density polyethylene resin (Novatec PP HP540 manufactured by Japan Polychem) were fitted to the steps of both end sides of the electric resistance adjusting layer and joined with an adhesive. Then, a simultaneous finish was performed by the cutting work to make the external diameter of the electric resistance adjusting layer to be 12.0 mm and to make external diameters of the gap retaining members to be 12.1 mm, and the gap retaining members were formed in dimensions as shown in FIG. 5 (e.g., thickness of an outer peripheral surfaces of gap retaining members a: 0.4 mm, width of outer end surface b: 2 mm, width c in a longer direction: 8 mm, and gap d: 0.5 mm).

A surface layer with a thickness of about 10 micrometers was formed by spraying and coating a surface of the electric resistance adjusting layer from an amalgam (the volume resistivity value: $2\times10^{10}$ Ω·cm) including acryl silicon resin (3000VH-P manufactured by KAWAKAMI PAINT), isocyanate series curative agent (manufactured by KAWAKAMI PAINT) and carbon black (in 30% by weight in total solid). After that, the coated resin was heat-hardened in an oven at 80 degrees for 1 hour and then an electrical conductive member was obtained.

Second Embodiment

An electrical conductive supporter (a core axis) made of stainless with an external diameter of 8 mm was coated by an injection molding with a resin composition (the volume resistivity value: $2\times10^{8}$ Ω·cm) including ABS resin (Denka ABS GR-0500 manufactured by DENKI KAGAKU KOGYO) in 50% by weight and poly ether ester amide (IRGASTAT P18 manufactured by CHIBA SPECIALITY CHEMICALS) in 50% by weight. An electric resistance adjusting layer was formed, wherein an external diameter is 14 mm and external diameters of the both end sides of the steps are 11.1 mm.

Ring-shaped gap retaining members including high-density polyethylene resin (NovatecPP HP540 manufactured by Japan Polychem) were adhesively inserted into the steps of both end sides of the electric resistance adjusting layer. A simultaneous finish by the cutting work was performed to make external diameters (max diameters) of the gap retaining members to be 12.1 mm and to make the external diameter of the electric resistance adjusting layer to be 12.0 mm, and the gap retaining members were formed as shown in FIG. 5 (e.g., thickness of the external peripheral surface a: 0.5 mm, thickness of the outer-end surface b: 2 mm, thickness in longer direction c; 8 mm, and gap d: 0.5 mm).

A surface layer with a thickness of about 10 micrometers was formed by spraying and coating a surface of the electric resistance adjusting layer from an amalgam including acryl silicon resin (3000VH-P manufactured by KAWAKAMI PAINT), isocyanate series curative agent (manufactured by KAWAKAMI PAINT) and carbon black (in 30% by weight in total solid). After that, the coated resin was heat-hardened in an oven at 80 degrees for 1 hour and then an electrical conductive member was obtained.

Third Embodiment

An electrical conductive supporter (a core axis) made of stainless with an external diameter of 8 mm was coated by an injection molding with a resin composition (the volume resistivity value: $2\times10^8$ Ω·cm) including ABS resin (Denka ABS GR-0500 manufactured by DENKI KAGAKU KOGYO) in 50% by weight and poly ether ester amide (IRGASTAT P18 manufactured by CHIBA SPECIALITY CHEMICALS) in 50% by weight. An electric resistance adjusting layer was formed wherein the external diameter was 14 mm and external diameters of both end sides of steps are 10.9 mm.

Ring-shaped gap retaining members including high-density polyethylene resin (NovatecPP HP540 manufactured by Japan Polychem) were adhesively inserted into the steps of both end sides of the electric resistance adjusting layer. Then, a simultaneous finish was performed by the cutting work to make the external diameter of the electric resistance adjusting layer to be 12.0 mm and external diameters of the gap retaining members to be 12.1 mm, and the gap retaining members were formed in dimensions as shown in FIG. 5 (e.g., thickness of outer peripheral surfaces of the gap retaining members a: 0.4 mm, width of outer end surface b: 2 mm, width c in longer direction: 8 mm, and gap d: 0.5 mm).

A surface layer with the thickness of about 10 micrometers was formed by spraying and coating the surface of the electric resistance adjusting layer from an amalgam including acryl silicon resin (3000VH-P, manufactured by KAWAKAMI PAINT), isocyanate series curative agent (manufactured by KAWAKAMI PAINT) and carbon black (30% by weight in total solid). After that, the coated resin was heat-hardened in an oven at 80 degrees for 1 hour and then an electrical conductive member was obtained.

Fourth Embodiment

An electrical conductive supporter (a core axis) made of stainless with the external diameter of 8 mm was coated by an injection molding with a resin composition (the volume resistivity value: 2×108 Ω·cm) including ABS resin (Denka ABS GR-0500 manufactured by DENKI KAGAKU KOGYO) in 50% by weight and poly ether ester amide (IRGASTAT P18 manufactured by CHIBA SPECIALITY CHEMICALS) in 50% by weight. An electric resistance adjusting layer was formed wherein the external diameter was 14 mm and external diameters of the both end sides steps are 10.9 mm.

Ring-shaped gap retaining members including high-density polyethylene resin (Novatec PP HP540 manufactured by Japan Polychem) were adhesively inserted into the steps of both end sides of the electric resistance adjusting layer. Then, a simultaneous finish was performed by the cutting work to make an external diameter of the electric resistance adjusting layer to be 12.0 mm and external diameters of the gap retaining members to be 12.1 mm, and the gap retaining members were formed in the dimensions as shown in FIG. 5 (e.g., thickness of outer peripheral surface of the gap retaining member a: 0.5 mm, width of outer end surface b: 1.5 mm, width c in longer direction: 7.5 mm, and gap d: 1.0 mm).

A surface layer with the thickness of about 10 micrometers was formed by spraying and coating the surface of the electric resistance adjusting layer from an amalgam including acryl silicon resin (3000 VH-P manufactured by KAWAKAMI PAINT, isocyanate series curative agent (manufactured by KAWAKAMI PAINT) and carbon black (30% by weight in total solid). After that, the coated resin was heat-hardened in an oven at 80 degrees for 1 hour and then an electrical conductive member was obtained.

COMPARATIVE EXAMPLE 1

An electrical conductive supporter (a core axis) made of stainless with an external diameter of 8 mm was coated with a gum composition (the volume resistivity value: 4×108 Ω·cm) with an epichlorohydrin gum (EPICHLOMER CG manufactured by DAISO) in 100% by weight containing ammonium perchlorate in 3% by weight after an injection molding and a vulcanizing process. Then an electric resistance adjusting layer with an external diameter of 12 mm was formed by grinding.

A surface layer with a thickness of 10 micrometers was formed on a surface of the electric resistance adjusting layer from an amalgam of polyvinyl butyral resin (DENKA BUTYRAL 3000-K manufactured by DENKI KAGAKU KOGYO), isocyanate series curative agent and tin chloride (60% by weight in total solid). Ring-shaped gap retaining members (an external diameter: 12.1 mm) including polyamide resin (NOVAMID 1010C2 manufactured by Mitsubishi Engineering-Plastics Corporation) were adhesively inserted into on the both end portions of the surface layer. Then, an electrical conductive member for a comparative example was obtained.

COMPARATIVE EXAMPLE 2

An electrical conductive supporter made of stainless with an external diameter of 8 mm was coated with a gum composition (volume resistivity value: 4×108 Ω·cm) by way of an injection molding and a vulcanizing process, wherein the gum composition includes an epichlorohydrin gum EPICHLOMER CG, manufactured by DAISO) in 100% by weight supplemented with ammonium perchlorate 3% by weight. Then, an electric resistance adjusting layer with an external diameter of 12 mm was formed by grinding.

A surface layer with a thickness of 10 micrometers is formed on a surface of the electric resistance adjusting layer from an amalgam including polyvinyl butyral resin (DENKA BUTYRAL 3000-K manufactured by DENKI KAGAKU KOGYO), isocyanate series curative agent and tin chloride (60% by weight in total solid). Then the both end portions of the surface layer are coated with tape-shaped members (DI-TAC® PF025-H manufactured by DAINIPPON INK AND CHEMICALS, INCORPORATED), wherein the thickness is 60 micrometers and the width is 8 mm, as the gap retaining members. Then, an electrical conductive member for a comparative example was obtained.

COMPARATIVE EXAMPLE 3

An electrical conductive supporter (a core axis) made of stainless with an external diameter of 8 mm was coated by an injection molding with a resin composition (the volume resistivity value: 2×108 Ω·cm) including ABS resin (Denka ABS GR-0500 manufactured by DENKI KAGAKU KOGYO) in 50% by weight and poly ether ester ode (IRGASTAT P18 manufactured by CEMBA SPECIALITY CHEMICALS) in 50% by weight.

Ring-shaped gap retaining members including polyamide resin (NOVAMID 1010C2 manufactured by Mitsubishi Engineering Plastics Corporation) were adhesively inserted into both end sides of an electric resistance adjusting layer, and to make external diameters of the gap retaining members to be 12.1 mm and an external diameter (a max diameter) of the electric resistance adjusting layer to be 12.0 mm in a simultaneous finish by the cutting work.

Each of the electrical conductive members as an electrical charge member (a charge roller) obtained from the embodiments 1 to 4 and the comparative examples 1 to 3 was installed into an image forming apparatus as shown in FIG. 1. First, a gap volume between the electrical charge member (the charge roller) and a photoconductive drum was measured at room temperature (23 degrees, 60% RH). Then, the volume of environmental variation between the electrical charge member (the charge roller) and the photoconductive drum was measured respectively under such environmental variation conditions after incubation for 24 hours in a low-temperature-low-humidity condition and in a high-temperature-high-humidity condition.

In addition, a voltage applied to the electrical charge member (the charge roller) at this time is DC=−800 V, AC=2.4 kVpp (Frequency: 2 kHz). An evaluating condition at this time is switched per 10,000 sheets of image outputs among a normal temperature condition (23 degrees, 60% RH), a low-temperature-low-humidity condition (10 degrees, 65% RH), and a high-temperature-high-humidity condition (30 degrees, 90% RH).

As apparent from the evaluation results shown in Table 1, in the electrical charge member (the charge roller) according to embodiments 1 to 4, as described above, no shape distortion of the gap retaining members occurs and the gap between the electric resistance adjusting layer and an image carrier is kept in a constant state with a good accuracy for a long-term, so that the environmental variation of the gap volume is small with no relation to the environmental variation, and the toner adhesion onto a surface of the electrical charge member (the charge roller) is not revealed, furthermore the occurrence of the bad image (the image irregularity) due to the charge irregularity (the anomalous discharge) is also not revealed.

By contrast, in the charge rollers of the comparative examples 1 to 3, the variation of the gap volume is large and the toner adhesion onto the surface of the electrical charge member (the charge roller) is also revealed, and furthermore the bad image (the image irregularity) due to the charge irregularity (the anomalous discharge) is also revealed.

TABLE 1

| | Gap volume between electrical charge member and photo conductor (mm) | Environmental variation volume of gap (mm) | Gap volume between electrical charge member and photo conductor after 300,000 sheets of papers through (mm) | Toner adhesion to roller surface after 300,000 sheets of papers through | image state after 300,000 sheets of papers through |
|---|---|---|---|---|---|
| Embodiment1 | 0.05 ± 0.010 | 0.006 | 0.05 ± 0.011 | No | Good |
| Embodiment2 | 0.05 ± 0.008 | 0.008 | 0.05 ± 0.010 | No | Good |
| Embodiment3 | 0.05 ± 0.008 | 0.010 | 0.05 ± 0.010 | No | Good |
| Embodiment4 | 0.05 ± 0.008 | 0.008 | 0.05 ± 0.011 | No | Good |
| Comparative Example1 | 0.05 ± 0.030 | 0.023 | 0.04 ± 0.050 | Yes | Image irregularity exists |
| Comparative Example2 | 0.05 ± 0.020 | 0.025 | 0.03 ± 0.040 | Yes | Image irregularity exists |
| Comparative Example3 | 0.05 ± 0.012 | 0.030 | 0.05 ± 0.015 | Yes | Image irregularity exists |

In addition, each of the electrical conductive members and the electrical charge members (the charge rollers) obtained from the embodiments 1 to 4 and the comparative examples 1 to 3 was loaded on to the image forming apparatus as FIG. 1. And then, 300,000 sheets of recording papers were passed through the image forming apparatus. An evaluation of the gap volume between the electrical charge member (the charge roller) and the photoconductive drum was performed. The presence of toner adhesion on the electrical charge member (the charge roller) was checked. An occurrence of the bad image (the image irregularity) in an electrical charge irregularity (an anomalous discharge) was checked. These evaluations are shown in the Table 1.

What is claimed is:

1. An electric conductive member, comprising:

a long electric conductive supporter;

an electric resistance adjusting layer provided on a peripheral surface of said electric conductive supporter; and gap retaining members provided on both end sides of said electric resistance adjusting layer, wherein an outer peripheral surface of each of the gap retaining members abuts with each of the both end sides of an image carrier provided adjacent to said electric resistance adjusting layer to form a predetermined gap between said electric resistance adjusting layer and said image carrier, and—said electric resistance adjusting layer has at least one step provided in vicinity of each of the both ends in a longitudinal direction of the electric resistance adjusting layer, and an inner peripheral surface of each of said gap retaining members is fixed by abutting with at least two surfaces forming each of the steps of said electric resistance adjusting layer, and an inner end surface of each of said gap retaining members is out of contact with the most inner end surface forming each of the steps of said electric resistance adjusting layer.

2. The electric conductive member according to claim 1, wherein the inner peripheral surface of each of said gap retaining members is fitted to each of the steps of said electric resistance adjusting layer.

3. The electric conductive member according to claim 1, wherein the inner peripheral surface of each of said gap retaining members is fixed to each of the steps of said electric resistance adjusting layer by a glue.

4. The electric conductive member according to claim 1, wherein the inner peripheral surface of each of said gap retaining members is fixed to the at least one step of said electric resistance adjusting layer by a glue via a primer arranged in the inner peripheral surface of said electric resistance adjusting layer.

5. The electric conductive member according to claim 1, wherein a surface portion of each of said gap retaining members abutting with said image carrier, is made of an electrical insulating resin material.

6. The electric conductive member according to claim 1, wherein a volume resistivity value of each of said gap retaining members is $10^{13}$ Ω cm or more.

7. The electric conductive member according to claim 1, wherein the volume resistivity value of said electric resistance adjusting layer is $10^{6}$ to $10^{9}$ Ω cm or more.

8. The electric conductive member according to claim 1, wherein the difference of elevation of the outer peripheral surface of said gap retaining member to said electric resistance adjusting layer is formed by an integrate process of cut process which is performed on the outer periphery surfaces of said gap retaining member and said electric resistance adjusting layer.

9. The electric conductive member according to claim 1, wherein a surface layer is formed on said electric resistance adjusting layer.

10. The electric conductive member according to claim 9, wherein an electric resistance value of said surface layer on said electric resistance adjusting layer is larger than that of said electric resistance adjusting layer.

11. The electric conductive member according to claim 1, wherein said electric conductive member is an electric charge member charging an image carrier provided adjacent to the electric conductive member.

12. A process cartridge, comprising:

at least one unit composition;

the electric charge member as recited in claim 11; and an image carrier charged by the electrical charge member.

13. An image-forming unit, comprising:

an image carrier; and the electric conductive member as recited in claim 11 as an electric charge member charging said image carrier.

* * * * *